US007891542B2

(12) United States Patent
Vickerstaff

(10) Patent No.: US 7,891,542 B2
(45) Date of Patent: Feb. 22, 2011

(54) SLIDE AND SHELL CONTAINER

(75) Inventor: John Vickerstaff, Neuchatel (CH)

(73) Assignee: Philip Morris USA Inc., Richmond, VA (US)

( * ) Notice: Subject to any disclaimer, the term of this patent is extended or adjusted under 35 U.S.C. 154(b) by 112 days.

(21) Appl. No.: 11/998,431

(22) Filed: Nov. 30, 2007

(65) Prior Publication Data

US 2008/0142578 A1 Jun. 19, 2008

(30) Foreign Application Priority Data

Nov. 30, 2006 (EP) ..... 06256126

(51) Int. Cl.
*B65D 43/22* (2006.01)
*B65D 5/00* (2006.01)
*A24F 15/00* (2006.01)

(52) U.S. Cl. ..... 229/125.37; 229/129.1; 206/273

(58) Field of Classification Search ..... 229/129.1, 229/129, 117.27; 220/813, 812, 811, 254.5, 220/254.1; 206/249, 250, 251, 254, 255, 206/267, 270

See application file for complete search history.

(56) References Cited

U.S. PATENT DOCUMENTS 149,889 A 4/1874 Smith (Continued)

FOREIGN PATENT DOCUMENTS

DE 570 351 2/1933

(Continued)

OTHER PUBLICATIONS

International Search Report and Written Opinion mailed Apr. 1, 2009 for PCT/EP2009/000318.

(Continued)

*Primary Examiner*—Nathan J Newhouse
*Assistant Examiner*—Christopher Demeree
(74) *Attorney, Agent, or Firm*—Buchanan Ingersoll & Rooney PC

(57) ABSTRACT

A slide and shell container, which finds particular application as a pack for smoking articles such as cigarettes. The container includes an outer shell having opposed first, front, and second, rear, walls connected by opposed third and fourth, side, walls and an inner slide in the outer shell for slidable movement relative thereto between a closed position and an open position. The inner slide comprises: a body having a first, rear, wall and a second, bottom, wall; and a lid having a first, rear, wall, a second, top, wall and opposed third and fourth, side, walls. The rear walls of the body and the lid are connected along a hinge line about which the lid is pivotable when the inner slide is in the open position. The distance from the top to the bottom of the side walls of the lid is greater than the distance from the top of the rear wall of the lid to the hinge line and the portions of the side walls of the lid below the level of the hinge line do not impinge on the front wall of the outer shell when the inner slide is in the closed position. The portion of the side walls of the lid limit pivoting of the lid about the hinge line by impinging on the front wall of the outer shell when the inner slide is in the open position.

15 Claims, 2 Drawing Sheets

U.S. PATENT DOCUMENTS

| | | | | | |
|---|---|---|---|---|---|
| 727,600 | A | | 5/1903 | Doscher | |
| 1,185,560 | A | | 5/1916 | Walcutt | |
| 1,459,439 | A | | 6/1923 | Burton | |
| 1,562,497 | A | | 11/1925 | Roberts | |
| 1,608,229 | A | | 11/1926 | Twomley | |
| 2,163,828 | A | * | 6/1939 | Chalmers | 229/146 |
| 2,213,525 | A | | 9/1940 | LaFlamme | |
| 2,597,810 | A | | 5/1952 | Myers | |
| 2,799,441 | A | | 7/1957 | Nerney | |
| 2,872,097 | A | | 2/1959 | Graybill | |
| 2,929,542 | A | | 3/1960 | O'Gorman | |
| 3,311,283 | A | * | 3/1967 | Shimada et al. | 229/125.08 |
| 3,400,874 | A | | 9/1968 | Shimada et al. | |
| 3,416,719 | A | | 12/1968 | Pilger | |
| 3,858,788 | A | | 1/1975 | Phillips, Jr. | |
| 3,899,125 | A | * | 8/1975 | Andrews et al. | 220/495.01 |
| 3,933,299 | A | | 1/1976 | Shimada et al. | |
| 3,977,520 | A | * | 8/1976 | Grimm | 206/270 |
| 4,049,117 | A | | 9/1977 | Grimm | |
| 4,267,926 | A | | 5/1981 | Toimil | |
| 4,646,960 | A | | 3/1987 | Challand | |
| 4,714,082 | A | | 12/1987 | Banerjee et al. | |
| 4,729,508 | A | | 3/1988 | Erdmann et al. | |
| 4,779,723 | A | | 10/1988 | Focke et al. | |
| 4,923,059 | A | | 5/1990 | Evers et al. | |
| 5,692,525 | A | | 12/1997 | Counts et al. | |
| 6,044,973 | A | | 4/2000 | Vasudeva | |
| 6,162,516 | A | | 12/2000 | Derr | |
| 6,474,468 | B1 | | 11/2002 | Griffith | |
| 6,527,166 | B1 | | 3/2003 | Focke et al. | |
| 6,591,982 | B2 | * | 7/2003 | Focke et al. | 206/259 |
| 7,273,145 | B2 | | 9/2007 | Focke et al. | |
| 7,604,117 | B2 | | 10/2009 | Bourgoin et al. | |
| 2002/0000389 | A1 | | 1/2002 | Garcia | |
| 2004/0026271 | A1 | | 2/2004 | Conti et al. | |
| 2005/0029131 | A1 | | 2/2005 | Draghetti et al. | |
| 2005/0103654 | A1 | | 5/2005 | Hennessy | |
| 2006/0278542 | A1 | | 12/2006 | Pham et al. | |
| 2008/0121538 | A1 | | 5/2008 | Buse | |
| 2008/0128301 | A1 | | 6/2008 | Bourgoin et al. | |
| 2009/0008277 | A1 | | 1/2009 | Agirbas | |
| 2009/0065561 | A1 | | 3/2009 | Bourgoin et al. | |
| 2009/0184158 | A1 | | 7/2009 | Lutzig et al. | |
| 2010/0032324 | A1 | | 2/2010 | Lutzig et al. | |
| 2010/0065449 | A1 | | 3/2010 | Morgan et al. | |
| 2010/0155273 | A1 | | 6/2010 | Chatelain | |
| 2010/0176011 | A1 | | 7/2010 | Chatelain | |

FOREIGN PATENT DOCUMENTS

| | | | |
|---|---|---|---|
| DE | 1054373 | B | 4/1959 |
| DE | 7525528 | U | 12/1975 |
| DE | 7826336 | U1 | 12/1978 |
| DE | 90 11 464 | | 1/1991 |
| DE | 20 2005 011562 | | 9/2005 |
| EP | 1927549 | A1 | 11/2006 |
| EP | 1847478 | A1 | 10/2007 |
| FR | 1037831 | A | 9/1953 |
| FR | 2495114 | A | 6/1982 |
| GB | 395 501 | | 7/1933 |
| GB | 468409 | | 7/1937 |
| GB | 532 784 | | 1/1941 |
| GB | 1042445 | | 9/1966 |
| GB | 1075618 | A | 7/1967 |
| GB | 2 309 021 | A | 7/1997 |
| GB | 2 396 854 | A | 7/2004 |
| JP | 2000-85749 | | 3/2000 |
| WO | WO 03/024839 | A | 3/2003 |
| WO | WO 03/091130 | | 11/2003 |
| WO | WO 2005/016036 | A1 | 2/2005 |
| WO | WO 2007/028481 | A1 | 3/2007 |
| WO | WO 2007/060395 | A1 | 5/2007 |
| WO | WO 2008/065038 | | 6/2008 |

OTHER PUBLICATIONS

Search Report from European Patent Application No. EP07115236.
International Search Report and Written Opinion mailed May 11, 2009 for PCT/IB2008/003014.
International Search Report dated Jun. 4, 2008 for European Patent Application No. 08253880.2-1261.
International Search Report and Written Opinion mailed Apr. 8, 2010 for PCT/EP2009/009215.
International Preliminary Report on Patentability issued Mar. 2, 2010 for PCT/IB2008/003014.
International Search Report for European Application No. 06125140.1-2308 dated May 2, 2007.
International Search Report and Written Opinion mailed Apr. 21, 2010 for PCT/EP2009/008831.
International Search Report dated Feb. 3, 2010 for European Patent Application No. 09252010.5-2308.
U.S. Appl. No. 12/858,874 to Chatelain et al., filed Aug. 18, 2010.

* cited by examiner

SLIDE AND SHELL CONTAINER

CROSS REFERENCE TO RELATED APPLICATION

This application claims priority under 35 U.S.C. §119 to European Application No. 06256126.1, filed Nov. 30, 2006, the entire content of which is hereby incorporated by reference.

FIELD OF THE INVENTION

The present invention relates to an improved slide and shell container that finds particular application as a pack for elongate smoking articles such as cigarettes.

BACKGROUND

It is known to package smoking articles and other consumer goods in containers comprising an outer shell or sleeve and an inner slide or drawer mounted in the outer shell for slidable movement relative thereto. To access goods housed in the inner slide of such "slide and shell" containers, a consumer pushes the inner slide from an initial closed position, in which the inner slide is surrounded by the outer shell, to an open position, in which a portion of the inner slide projects outwardly from the outer shell in order to expose an open end or side of the inner slide through which the goods may be removed.

Slide and shell cigarette packs in which the cigarettes are housed in an inner slide having a hinged lid that covers an open end of the inner slide are also known, for example from U.S. Pat. No. 3,400,874 and U.S. Pat. No. 3,933,299.

The slide and shell packs disclosed in U.S. Pat. No. 3,400,874 and U.S. Pat. No. 3,933,299 suffer from the disadvantage that apertures or gaps are formed between the side walls of the lid of the inner slide and the side walls of the remainder of the slide and shell pack as the lid hinges open. Aside from being aesthetically undesirable, such apertures may disadvantageously result in the inadvertent loss of goods from the inner slide of the pack.

It would be desirable to provide a slide and shell container for smoking articles and other consumer goods comprising an inner slide with a lid wherein opening of the lid does not result in the formation of significant apertures in the sides of the container.

It would also be desirable to provide a slide and shell container for smoking articles and other consumer goods having an automatic lid opening-mechanism wherein the lid is opened to a pre-determined maximum extent upon activation of the lid-opening mechanism.

SUMMARY

According to one embodiment there is provided a slide and shell container comprising: an outer shell having opposed front and rear walls connected by opposed side, walls; an inner slide in the outer shell for slidable movement relative thereto between a closed position and an open position, the inner slide comprising: a body having a rear wall and a bottom wall; and a lid having a rear wall, a top wall and opposed side walls, the rear walls of the body and the lid being connected along a hinge line about which the lid is pivotable when the inner slide is in the open position, wherein the distance from the top to the bottom of the side walls of the lid is greater than the distance from the top of the rear wall of the lid to the hinge line and the portions of the side walls of the lid below the level of the hinge line do not impinge on the front wall of the outer shell when the inner slide is in the closed position and limit pivoting of the lid about the hinge line by impinging on the front wall of the outer shell when the inner slide is in the open position.

The portions of the side walls of the lid below the level of the hinge line extend partially across the corresponding side walls of the outer shell stopping short of the front wall of the outer shell when the slide is in the closed position.

As described further below, the portions of the side walls of the lid of the inner slide below the hinge line advantageously limit pivotal movement of the lid about the hinge line when the inner slide is in the open position.

In addition, as the portions of the side walls of the lid of the inner slide below the hinge line impinge on the inner surface of the front wall of the outer shell, no significant apertures are formed in the sides of the container when the lid of the inner slide is hinged open.

In use, consumer goods packaged in the container are housed in the body of the inner slide.

Slide and shell containers as described above preferably further comprise means to prevent the bottom ends of the side walls of the lid of the inner slide from leaving the top of the outer shell.

Preferably, the portions of the side walls of the lid of the inner slide below the level of the hinge are narrower than the portions of the side walls of the inner slide above the hinge.

The portions of the side walls of the lid of the inner slide below the hinge line are narrower than the side walls of the outer shell.

Preferably, the portions of the side walls of the inner slide above the hinge line are of similar width to the side walls of the outer shell.

Preferably, the portions of the side walls of the lid of the inner slide below the hinge line are tapered. Preferably, the tapered edges of the side walls of the lid of the inner slide below the hinge line are substantially parallel to the front wall of the outer shell when the portions of the side walls of the lid below the hinge line impinge on the front wall of the outer shell.

In a preferred embodiment, the rear wall of the outer shell is of reduced height compared to the front wall of the outer shell. In use, this allows the consumer to move the inner slide in the outer shell from the closed position to the open position more easily.

Preferably, the difference in length between the front wall and the rear wall of the outer shell is approximately equal to the distance the inner slide moves in the outer shell from the closed position to the open position. In use, the bottom wall of the inner slide may be pushed up to the level of the lower edge of the rear wall in order to move the inner slide from the closed position to the open position.

Preferably, the slide and shell container comprises a lid opening mechanism, the lid opening mechanism comprising: a first abutment edge projecting inwardly from the rear wall of the outer shell; and a hook provided on a lower portion of a flap extending from the top wall of the lid of the inner slide between the rear wall of the outer shell and the rear walls of the lid and body of the inner slide, whereby slidable movement of the inner slide within the outer shell from the closed position to the open position causes the hook to engage the first abutment edge thereby pivoting the lid of the inner slide about the hinge line.

Preferably, the abutment edge is a free edge of an inwardly folded flap extending from the upper edge of the rear wall of the outer shell. The flap may be affixed to the inner surface of the rear wall of the outer shell using, for example, an adhesive.

Preferably, the slide and shell container further comprises limiting means to prevent movement of the inner slide beyond the closed position.

Preferably, the limiting means comprises a first abutment edge projecting inwardly from the front wall or the rear wall of the outer shell; and a second abutment edge projecting outwardly from the front wall or the rear wall of the body of the inner slide, wherein the first abutment edge provided on the outer shell and the second abutment edge provided on the body of the inner slide abut one another when the inner slide is in the closed position.

In a preferred embodiment, the first abutment edge is a free edge of an inwardly folded flap extending from the lower edge of the front wall of the outer shell and the second abutment edge is a free edge of an outwardly folded flap extending from the upper edge of a front wall of the body of the inner slide. The flaps may be affixed to the inner surface of the rear wall of the outer shell and the outer surface of the front wall of the body of the inner slide using, for example, an adhesive.

Slide and shell containers may comprise an inwardly folded flap extending from the upper edge of the front wall of the outer shell. The flap may be affixed to the inner surface of the front wall of the outer shell using, for example, an adhesive. The fold line formed between the inwardly folded flap and the front wall panel of the outer shell advantageously provides a neat, dull upper edge to the front wall of the outer shell.

If desired, slide and shell containers may include outer shells further comprising a bottom wall with an aperture or window provided therein through which, in use, a consumer may push on the bottom wall of the body of the inner slide in order to open the container. Alternatively or in addition, one or more apertures or windows may be provided in the front wall, rear wall, side walls or combinations thereof of the outer shell to facilitate movement of the inner slide from the closed position to the open position by the consumer. One or more apertures extending across more than one wall of the outer shell may also be provided.

Slide and shell containers may be advantageously employed as packaging for a variety of consumer goods. In a preferred embodiment, the inner slide houses a plurality of smoking articles. The smoking articles may be, for example, cigarettes, cigars or cigarillos. Preferably, the smoking articles are cigarettes. Slide and shell containers may be designed to contain different numbers of, for example, conventional size, king size, super-king size, slim or super-slim cigarettes through an appropriate choice of the dimensions thereof.

Where the inner slide houses a bundle of cigarettes or other smoking articles, the smoking articles are preferably wrapped in an inner liner of, for example, metal foil, plastic or metallised paper.

The outer shell and the inner slide may be formed from the same or different materials. The outer shell and the inner slide may, for example, be formed from cardboard, paperboard, plastic, metal or combinations thereof of from any other suitable materials.

Preferably, the outer shell and the inner slide are formed from folded laminar blanks, more preferably from folded laminar cardboard blanks.

The outer surface of the outer shell may be printed, embossed or otherwise embellished (for example, using labels or stickers) with manufacturer or brand logos, trade marks, slogans and/or other consumer information and indicia.

The outer surface of the inner slide may also be printed, embossed or otherwise embellished (for example, using labels or stickers) with manufacturer or brand logos, trade marks, slogans or other consumer information and indicia.

The outer shell and the inner slide may have right-angled longitudinal edges, right-angled transverse edges, rounded longitudinal edges, rounded transverse edges, bevelled longitudinal edges, bevelled transverse edges or any suitable combination thereof.

For example, by scoring in a known manner laminar cardboard blanks from which the outer shell and the inner slide are erected, a "rounded-corner" slide and shell container of smoking articles or other consumer goods may be produced.

Preferably, the external dimensions of the inner slide are substantially the same as the internal dimensions of the outer shell thereof. In use, frictional forces generated between inner surfaces of the outer shell that overlie and abut outer surfaces of the inner slide resist slidable movement of the inner slide within the outer shell between the closed position and the open position, thereby advantageously preventing opening and closing of the slide and shell container without the application of a positive force by a consumer.

Slide and shell containers of smoking articles or other consumer goods as described herein may be shrink wrapped or otherwise over wrapped with a transparent polymeric film of, for example, polyethylene or polypropylene in a conventional manner. Where the slide and shell containers are over wrapped, the over wrapper may include a tear tape.

According to another embodiment there is also provided a blank for an inner slide of a slide and shell container, the inner slide comprising a body and a lid, the blank comprising: a first, rear, lid wall panel foldably connected along a first edge to a first, rear, body wall panel and along a second edge opposite the first edge to a second, top, lid wall panel; and third and fourth, side, lid wall panels foldably connected to the rear, lid wall panel, along opposed second and third edges thereof characterised in that the side, lid wall panels extend beyond the rear lid wall panel alongside but not connected to the rear, body wall panel.

DETAILED DESCRIPTION

Figure 2:
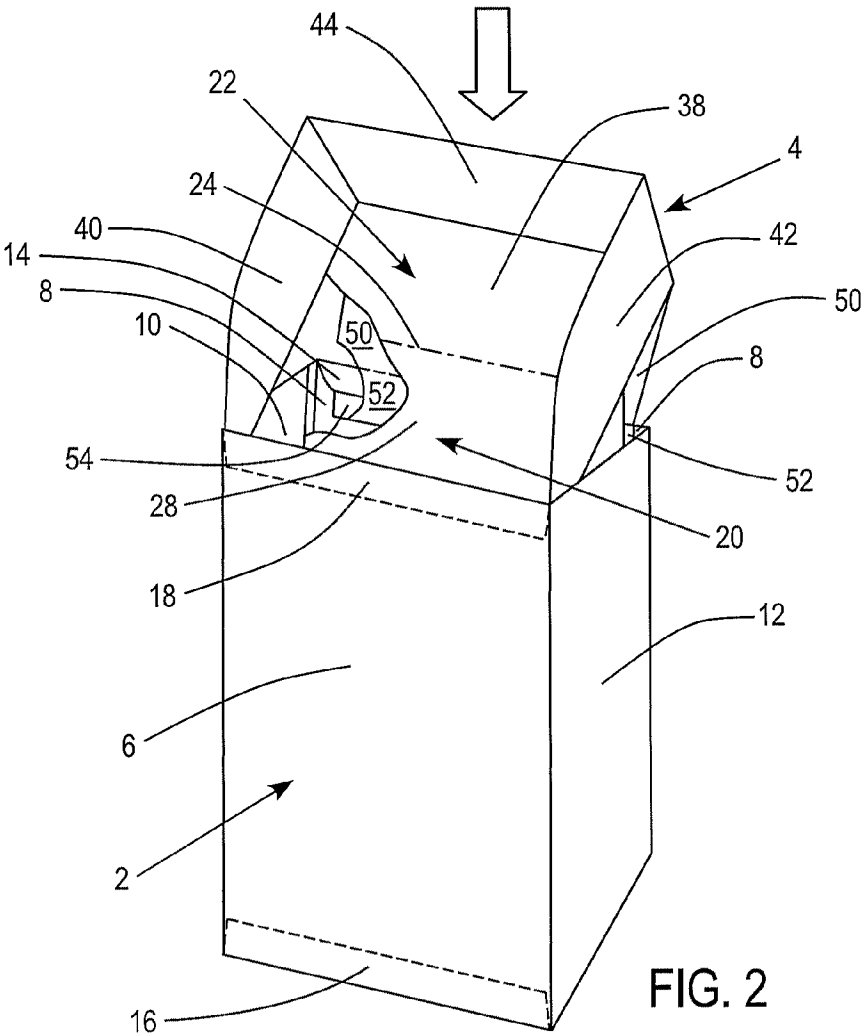
FIG. 2 shows a perspective view of the slide and shell container of FIG. 1 with the inner slide in the open position, with portions removed to reveal abutting surfaces.

In the following description of FIGS. 1, 2, 3 and 4 the terms 'front', 'rear', 'bottom', 'top', 'upper' and 'lower' refer to the position of a wall, flap, panel, edge or portion thereof in relation to the orientation of the slide and shell container as shown in FIG. 2. The rear of the container is defined as the side of the container with the hinge. The top of the container is defined as the end of the container from which the contents of the container are removed.

Figure 1:
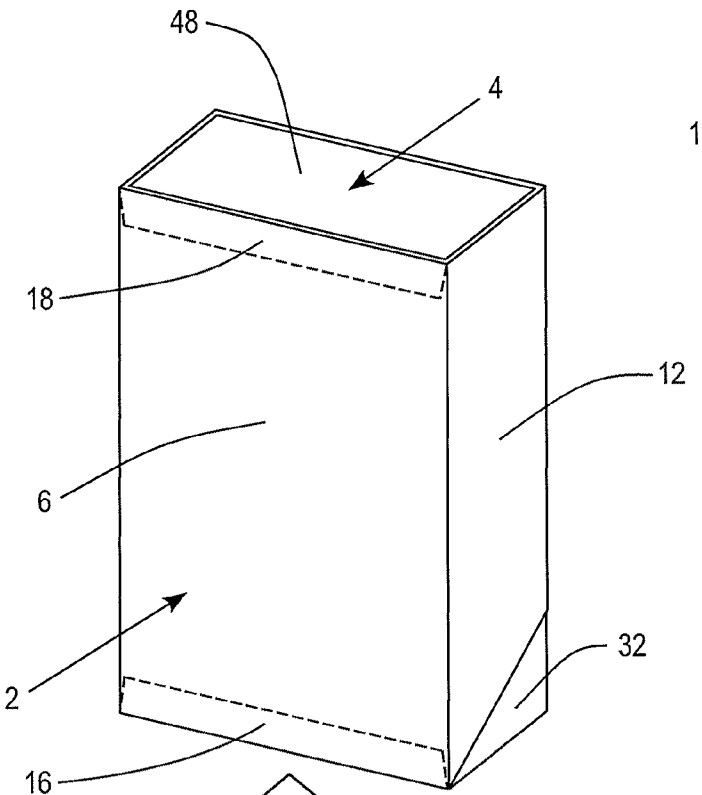
FIG. 1 shows a perspective view of a slide and shell container according to an embodiment with the inner slide in the closed position.

The slide and shell container shown in FIGS. 1 and 2 is a rectangular parallelepiped and generally comprises an outer shell 2 and an inner slide 4 slidably mounted within the outer shell 4.

The outer shell 2, which is an open-ended sleeve of rectangular cross-section, has a rectangular front wall 6, an opposed rectangular rear wall 8 and a pair of opposed trapezoidal side walls 10, 12. As shown in FIGS. 1 and 2, the rear wall 8 of the outer shell 2 is of reduced height compared to the front wall 6 thereof, so that the lower edge of the rear wall 8 is offset in height relative to the lower edge of the front wall 6. The lower edges of the opposed side walls 10, 12, which extend between the front wall 6 and the rear wall 8, are angled upwardly from the front to the rear of the outer shell 2.

A first flap 14 (not shown in FIGS. 1 and 2), which is adjacent and parallel to the inner surface of the rear wall 8 of the outer shell 2, extends from the upper edge of the rear wall 8 of the outer shell 2 and a second flap 16 (shown by broken lines in FIGS. 1 and 2), which is adjacent and parallel to the inner surface of the front wall 6 of the outer shell 2, extends from the lower edge of the front wall 6 of the outer shell 2.

The outer shell 2 also further comprises a third flap 18 (shown by broken lines in FIGS. 1 and 2), which like the second flap 16 is adjacent and parallel to the inner surface of the front wall 6 of the outer shell 2, but which extends from the upper edge of the front wall 6 of the outer shell 2.

The inner slide 4 comprises a lower body 20 and an integral upper lid 22, which is hinged to the body 20 along a transverse hinge line 24 extending across the rear of the inner slide 4. The hinge line 24 may be defined by a simple fold or score line.

The term 'score line' is used throughout the specification to indicate a line formed by, for example, creasing, scoring, perforating, embossing or otherwise compressing, cutting or weakening the blanks in order to facilitate the formation of an edge or hinge along a predetermined line.

The body 20 has a rectangular front wall 26, an opposed rectangular rear wall 28, a pair of opposed side walls 30, 32 and a rectangular bottom wall 34. Only one side wall 32 and the rear wall 28 of the body 20 of the inner slide 4 are shown in FIGS. 1 and 2, respectively. The front wall 26 of the body 20 of the inner slide 4 is of reduced height compared to the rear wall 28 thereof, so that the hinge line 24, which defines the upper edge of the rear wall 26 of the body 20 of the inner slide 4, is offset in height relative to the upper edge of the front wall 26 of the body 20 of the inner slide 4.

The body 20 of the inner slide 4 further comprises a flap 36 (not shown in FIGS. 1 and 2, but shown in FIG. 4), which is adjacent and parallel to the outer surface of the front wall 26 of the body 20 and extends from the upper edge of the front wall 26 of the body 20.

The lid 22 of the inner slide 4 has a rectangular rear wall 38, a pair of opposed side walls 40, 42, and a rectangular top wall 44. As shown in FIG. 2, each of the pair of opposed side walls 40, 42 has a wider upper portion and a narrower lower portion. The outer free edges of the wider upper portions of the side walls 40, 42 of the lid 22 of the inner slide 4 are parallel to fold lines connecting the opposed side walls 40, 42 of the lid 22 to the rear wall 38 thereof. The outer free edges of the narrower lower portion of the side walls 40, 42 of the lid 22 of the inner slide 4 are inclined towards the rear wall 38 of the lid 22, so that the width of the lower portion of the side walls 40, 42 is reduced.

The wider upper portions of the side walls 40, 42 of the lid 22 of the inner slide 4 extend from the upper edges of the side walls 40, 42 to approximately the level of the hinge line 24. The narrower lower portions of the side walls 40, 42 of the lid 22 of the inner slide 4 extend from approximately the level of the hinge line 24 to the lower ends of the side walls 40, 42. The lower ends of the side walls 40, 42 of the lid 22 are rounded, otherwise the outer free edges of the narrower lower portions of the side walls 40, 42 of the lid 22 would meet the rear wall of the outer shell 2 at the point where the upper edges of the side walls 30, 32 of the outer shell 2 meet the side edges of the rear wall 28 of the body 20.

An elongate flap 46 comprising a first panel 48, a second panel 50, a third panel 52 and a fourth panel 54 extends from the front edge of the top wall 44 of the lid 22 of the inner slide 4. Only the first panel 48 and the second panel 50 of the flap 46 are shown in FIG. 2.

Figure 4:
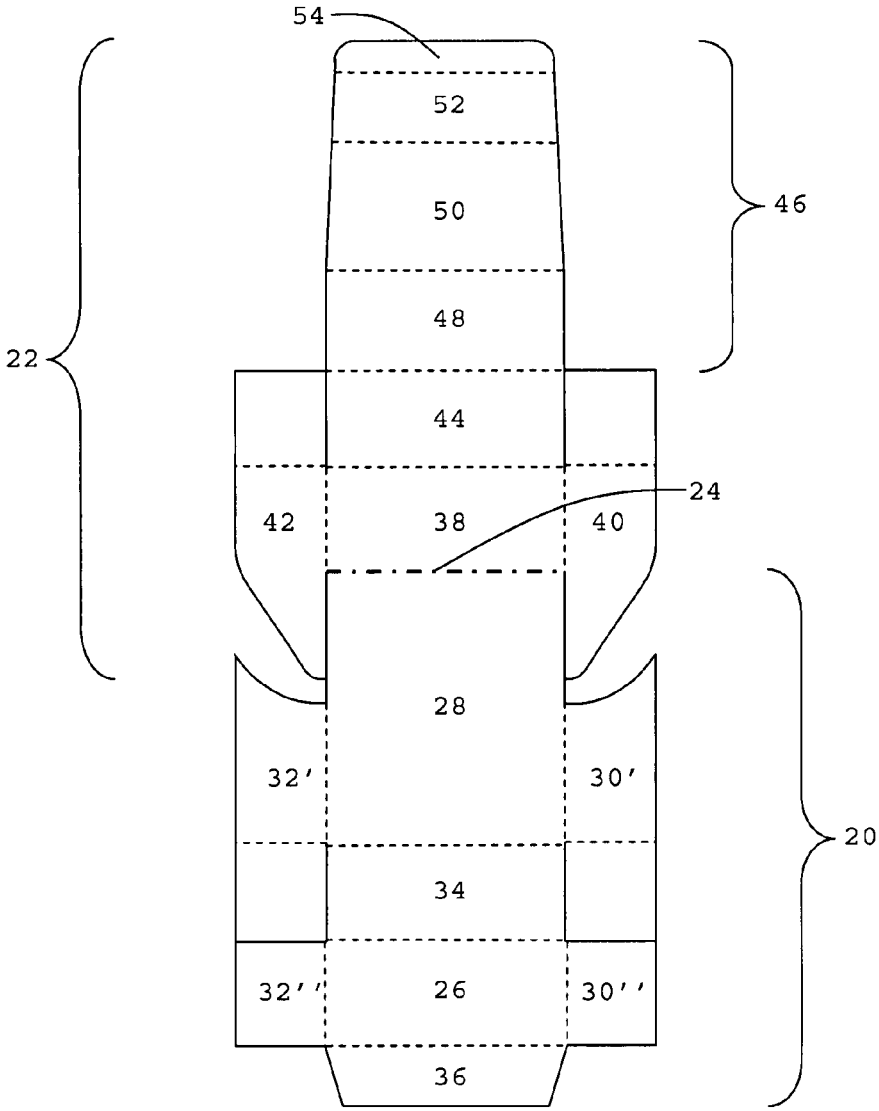
FIG. 4 shows a plan view of a one-piece laminar cardboard blank for forming the inner slide of the slide and shell container of FIGS. 1 and 2.

As shown in FIG. 4, the first panel 48, second panel 50, third panel 52 and fourth panel 54 of the flap 46 are separated from one another in the longitudinal direction of the flap by parallel transverse fold lines, which may be defined by simple score lines.

The first panel 48, which is substantially the same size and shape as the top wall 44 of the lid 22 of the inner slide 4, is folded back about the front edge of the top wall 44 of the lid 22 of the inner slide 4 so that it overlies the top wall 44 of the lid 22 of the inner slide 4, as shown in FIGS. 1 and 2. The flap 46 is folded about the transverse fold line separating the first panel 48 and the second panel 50 thereof, which overlies the rear edge of the top wall 44 of the lid 22 of the inner slide 4, so that in the closed position shown in FIG. 1, the second panel 50 and the third panel 52 of the flap 46 overlie the rear wall 38 of the lid 22 and the rear wall 28 of the body 20 of the inner slide 4.

The fourth panel 54 of the flap 46 is bent up about the transverse fold line separating it from the third panel 52 to provide an outwardly projecting hook.

As shown in FIG. 4, to facilitate movement of the flap 46 in the outer shell 2, the flap 46 is tapered along its length so that the fourth panel 54 at the outer end thereof is narrower than the first panel 48, which extends from the front edge of the top wall 44 of the lid 22 of the inner slide 4.

Figure 3:
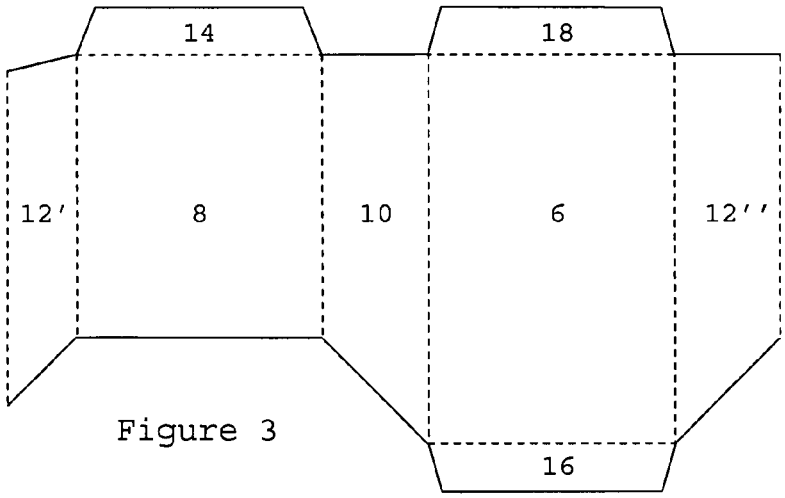
FIG. 3 shows a plan view of a one-piece laminar cardboard blank for forming the outer shell of the slide and shell container of FIGS. 1 and 2.

Cardboard blanks from which the outer shell 2 and the inner slide 4 of the slide and shell container of FIGS. 1 and 2 may be formed are shown in FIGS. 3 and 4, respectively. Corresponding reference numbers are used in FIGS. 3 and 4 for elements of the outer shell blank and the inner slide blank that are similar or related to elements of the container of FIGS. 1 and 2 previously described. Each blank includes various panels, flaps and tabs that when folded about appropriate score lines (shown in FIGS. 3 and 4 by broken lines) form the required parts of the slide and shell container shown in FIGS. 1 and 2.

As shown in FIG. 4, the upper edges of the inner side wall panels 30', 32' are curved such that the outer, free, side edges of the inner side wall panels 30', 32' are longer than the opposed inner side edges of the inner side wall panels 30', 32' along which the inner side wall panels 30', 32' are foldably connected to the rear wall 28 of the inner slide 4. The increased length of the outer, free, side edges of the inner side wall panels 30', 32' increases the stability of the inner slide 4 inside the outer shell 2 in the open position. The radius of curvature of the upper edges of the inner side wall panels 30', 32' may correspond to the distance between the upper ends of the inner side edges of the inner side wall panels 30', 32' and the hinge line 24.

Alternatively, the upper edges of the inner side wall panels 30', 32' may be angled.

It will be appreciated that the order in which the various panels, flaps and tabs of the one-piece cardboard blanks shown in FIGS. 3 and 4 are folded and secured to one another in order to form the outer shell 2 and the inner slide 4, respectively, of the slide and shell container shown in FIGS. 1 and 2 may be varied depending upon, for example, the apparatus used to produce the container.

In use, to open the formed slide and shell container a consumer pushes upon the bottom wall 34 of the body 20 of the inner slide 4, in the direction shown by the arrow in FIG. 1, in order to slide the inner slide 4 upwardly within the outer shell 2. As the inner slide 4 is urged upwards within the outer shell 2, the hook formed by the upwardly folded fourth panel 54 of the flap 46 extending from the lid 22 of the inner slide 4 engages the lower transverse free edge of the inwardly folded first flap 14 extending from the upper edge of the rear wall 8 of the outer shell 2. Once the hook and the first flap 14 are engaged, further upwards pressure on the bottom wall 34 of the body 20 of the inner slide 4 causes the lid 22 of the inner slide 4 to pivot open about the hinge line 24.

As shown in FIG. 2, at this point, the flap 46 is bent along the transverse fold line separating the second panel 50 and the third panel 52 thereof and the second panel 50 of the flap 46 is no longer parallel to and aligned with the rear wall 28 of the inner slide 4. The remainder of the inner slide 4 continues to move upward in the outer shell 2, and the lid 22 of the inner slide 4 continues to pivot backwards about the hinge line 24, until the lower front edges of the opposed side walls 40, 42 of the lid 22 of the inner slide 4 impinge on the inner surface of the front wall 56 of the outer shell thereby preventing further upward movement of the inner slide 4, and pivotal movement of the lid 22 thereof, beyond the fully open position shown in FIG. 2.

Once the inner slide 4 reaches the fully open position shown in FIG. 2, the consumer may remove smoking articles or other consumer goods housed in the slide and shell container from the inner slide 4.

To subsequently re-close the slide and shell container, the consumer pushes upon the first panel 48 of the flap 46 overlying the top wall 44 of the lid 22 of the inner slide 4, in the direction shown by the arrow in FIG. 2, in order to slide the inner slide 4 downwardly within the outer shell 2. When the inner slide 4 reaches the closed position shown in FIG. 1, the transverse lower free edge of the outwardly folded flap 36 extending from the upper edge of the front wall 26 of the body 20 of the inner slide 4 abuts the upper transverse free edge of the inwardly folded second flap 16 extending from the lower edge of the front wall 6 of the outer shell 2, thereby preventing further downward movement of inner slide 4 within the outer shell 2 beyond the closed position.

To help retain the inner slide 4 in the closed position shown in FIG. 1 until the consumer pushes upwardly on the bottom wall 34 of the inner slide 4, the external dimensions of the inner slide 4 and the internal dimensions of the outer shell 2 are preferably such that the inner slide 4 fits snugly within the outer shell 2 in the fully closed position shown in FIG. 1.

The outer shell of the slide and shell container shown in FIGS. 1 and 2 and described above has a rear wall that is of reduced height compared to the front wall thereof. Slide and shell containers as described herein may, however, comprise outer shells having front walls that are of reduced height compared to the rear walls thereof or outer shells that have front walls and rear walls of substantially the same size.

Furthermore, while the outer shell of the container shown in FIGS. 1 and 2 and described above has right-angled longitudinal edges and right-angled transverse edges, it will be appreciated that the slide and shell containers may have outer shells with right-angled longitudinal edges, right-angled transverse edges, rounded longitudinal edges, rounded transverse edges, bevelled longitudinal edges, bevelled transverse edges or any suitable combination thereof may be produced. Similarly, it will be appreciated that the slide and shell containers may have inner slides with right-angled longitudinal edges, right-angled transverse edges, rounded longitudinal edges, rounded transverse edges, bevelled longitudinal edges, bevelled transverse edges or any suitable combination thereof.

It will also be appreciated that as well as open ended outer shells, the slide and shell containers may comprise outer shells having a bottom wall with an aperture or window provided therein through which, in use, a consumer may push on the bottom wall of the body of the inner slide in order to open the slide and shell container.

The preferred embodiments are merely illustrative and should not be considered restrictive in any way. The scope of the invention is given by the appended claims, rather than the preceding description, and all variations and equivalents which fall within the range of the claims are intended to be embraced therein.

The invention claimed is:

1. A slide and shell container comprising:

an outer shell having opposed first front wall and second rear wall connected by opposed third and fourth side walls;

an inner slide in the outer shell for slidable movement relative thereto between a closed position and an open position, the inner slide comprising:

a body having a first rear wall and a second bottom wall; and a lid having a first rear wall, a second top wall and opposed third and fourth side walls, the rear walls of the body and the lid being connected along a hinge line about which the lid is pivotable when the inner slide is in the open position, wherein the distance from the top to the bottom of the side walls of the lid is greater than the distance from the top of the rear wall of the lid to the hinge line and the portions of the side walls of the lid below the level of the hinge line do not impinge on the front wall of the outer shell when the inner slide is in the closed position and limit pivoting of the lid about the hinge line by impinging on the front wall of the outer shell when the inner slide is in the open position.

2. A slide and shell container according to claim 1 wherein the portions of the side walls of the lid of the inner slide below the level of the hinge line are narrower than the side walls of the outer shell and the portions of the side walls of the lid of the inner slide above the level of the hinge line are of similar width to the side walls of the outer shell.

3. A slide and shell container according to claim 1 wherein the portions of the side walls of the lid of the inner slide below the hinge line are tapered.

4. A slide and shell container according to claim 1 comprising a lid opening mechanism, the lid opening mechanism comprising:

an abutment edge projecting inwardly from the rear wall of the outer shell; and a hook provided on a lower portion of a flap extending from the top wall of the lid of the inner slide between the rear wall of the outer shell and the rear walls of the lid and body of the inner slide, slidable movement of the inner slide within the outer shell from the closed position to the open position causes the hook to engage the first abutment edge thereby pivoting the lid of the inner slide about the hinge line.

5. A slide and shell container according to claim 4 wherein the abutment edge is a free edge of an inwardly folded flap extending from the upper edge of the rear wall of the outer shell.

6. A slide and shell container according to claim 1 further comprising limiting means to prevent movement of the inner slide beyond the closed position.

7. A slide and shell container according to claim 6 wherein the limiting means comprises:

a first abutment edge projecting inwardly from the front wall or the rear wall of the outer shell; and a second abutment edge projecting outwardly from the front wall or the rear wall of the body of the inner slide, wherein the first abutment edge provided on the outer shell and the second abutment edge provided on the body of the inner slide abut one another when the inner slide is in the closed position.

8. A slide and shell container according to claim 7 wherein the first abutment edge is a free edge of an inwardly folded flap extending from the lower edge of the front wall of the outer shell and the second abutment edge is a free edge of an outwardly folded flap extending from the upper edge of a front wall of the body of the inner slide.

9. A slide and shell container according to claim 1 further comprising an inwardly folded flap extending from the upper edge of the front wall of the outer shell.

10. A slide and shell container comprising:

an outer shell having opposed first front wall and second rear wall connected by opposed third and fourth side walls;

an inner slide in the outer shell for slidable movement relative thereto between a closed position and an open position, the inner slide comprising:

a body having a first rear wall and a second bottom wall;

a lid having a first rear wall, a second top wall and opposed third and fourth, side walls; and means to prevent the bottom ends of the side walls of the lid of the inner slide from leaving the top of the outer shell, the rear walls of the body and the lid being connected along a hinge line about which the lid is pivotable when the inner slide is in the open position, wherein the distance from the top to the bottom of the side walls of the lid is greater than the distance from the top of the rear wall of the lid to the hinge line and the portions of the side walls of the lid below the level of the hinge line do not impinge on the front wall of the outer shell when the inner slide is in the closed position and limit pivoting of the lid about the hinge line by impinging on the front wall of the outer shell when the inner slide is in the open position.

11. A slide and shell container comprising:

an outer shell having opposed first front wall and second rear wall connected by opposed third and fourth side walls;

an inner slide in the outer shell for slidable movement relative thereto between a closed position and an open position, the inner slide comprising:

a body having a first rear wall and a second bottom wall;

a lid having a first rear wall, a second top wall and opposed third and fourth, side walls; and the rear walls of the body and the lid being connected along a hinge line about which the lid is pivotable when the inner slide is in the open position, wherein the distance from the top to the bottom of the side walls of the lid is greater than the distance from the top of the rear wall of the lid to the hinge line and the portions of the side walls of the lid below the level of the hinge line do not impinge on the front wall of the outer shell when the inner slide is in the closed position and limit pivoting of the lid about the hinge line by impinging on the front wall of the outer shell when the inner slide is in the open position and wherein the distance from the top to the bottom of the front wall of the outer shell is greater than the distance from the top to the bottom of the rear wall of the outer shell.

12. A blank for an inner slide of a slide and shell container, the inner side comprising a body and a lid, the blank comprising:

a first rear lid wall panel foldably connected along a first edge to a first rear body wall panel and along a second edge opposite the first edge to a second top lid wall panel; and third and fourth side lid wall panels foldably connected to the first rear lid wall panel, along opposed second and third edges thereof, wherein the side lid wall panels extend beyond the rear lid wall panel alongside but not connected to the rear body wall panel, wherein the side lid wall panels have a width adjacent to the rear lid wall panel and are narrower than that width at the portions thereof alongside the rear body wall panel, and wherein the shell container comprises a front panel, a rear panel smaller in height than the front panel, a first side panel between the front and rear panels, a second side panel on a side edge of the front panel, a third side panel on a side edge of the rear panel, a first flap panel on a top edge of the rear panel, a second flap panel on a top edge of the front panel and a third flap panel on a bottom edge of the front panel.

13. The blank according to claim 12, wherein the side lid a wall panels are tapered at the portions thereof alongside the rear body wall panel.

14. The blank according to claim 12, wherein the lid includes a flap panel extending from an edge of the top lid wall panel.

15. The blank according to claim 12, wherein the body includes a bottom wall panel extending from an edge of the first rear body wall panel and a flap panel extending from an edge of the bottom wall panel.

* * * * *